United States Patent [19]

Morse

[11] 4,182,136

[45] Jan. 8, 1980

[54] SUCTION ACCUMULATOR

[75] Inventor: Robert L. Morse, Adrian, Mich.

[73] Assignee: Tecumseh Products Company, Tecumseh, Mich.

[21] Appl. No.: 863,262

[22] Filed: Dec. 22, 1977

[51] Int. Cl.[2] ..... F25B 43/00

[52] U.S. Cl. ..... 62/503; 55/192

[58] Field of Search ..... 62/503; 55/192, 199

[56] References Cited

U.S. PATENT DOCUMENTS

| | | | |
|---|---|---|---|
| 2,059,725 | 11/1936 | Carrier | 62/503 |
| 2,691,873 | 10/1954 | Skoli et al. | 62/503 |
| 3,092,978 | 6/1963 | Lorentzen | 62/503 |
| 3,563,053 | 2/1971 | Bottum | 62/503 |
| 3,643,466 | 2/1972 | Bottum | 62/503 |
| 3,698,207 | 10/1972 | Melnyk | 62/503 |
| 3,726,068 | 4/1973 | Lowrie | 55/421 |
| 3,796,064 | 3/1974 | Ladusaw | 62/503 |
| 3,837,177 | 9/1974 | Rockwell et al. | 62/503 |
| 3,872,689 | 3/1975 | Bottum | 62/503 |
| 4,009,596 | 3/1977 | Morse | 62/503 |
| 4,111,005 | 9/1978 | Livesay | 62/503 |

*Primary Examiner*—Ronald C. Capossela

*Attorney, Agent, or Firm*—Albert L. Jeffers; John F. Hoffman

[57] ABSTRACT

A suction accumulator for the compressor of a refrigeration system comprising a storage vessel having an inlet and an outlet located within the upper portion thereof, a generally rounded peripheral side wall and a U-shaped conduit extending downwardly into the lower portion of the vessel. One end of the conduit is connected to the outlet and the other end is open to the interior of the vessel. A generally funnel-shaped bleed-through orifice in the lowermost portion of the conduit causes liquid refrigerant and oil to be drawn into the stream of gaseous refrigerant flowing through the conduit. A baffle interposed between the inlet and outlet of the vessel has a peripheral portion positioned below the inlet which is spaced slightly from the side wall so as to cause swirling movement of the incoming refrigerant in close proximity to the side wall of the vessel.

24 Claims, 10 Drawing Figures

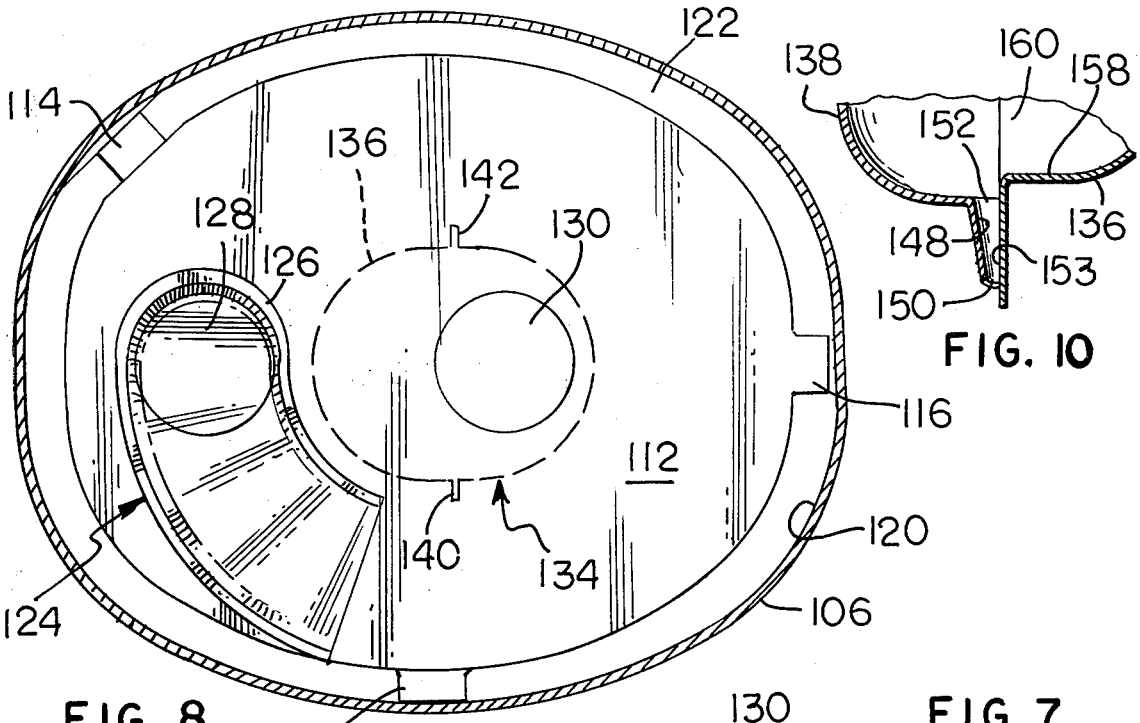
FIG. 8
FIG. 10
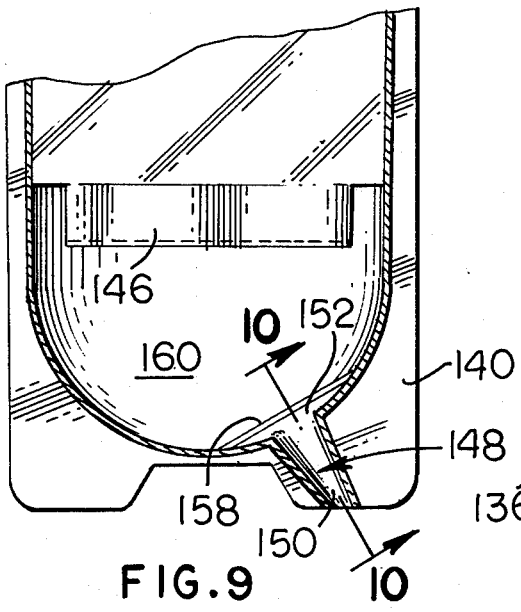
FIG. 9
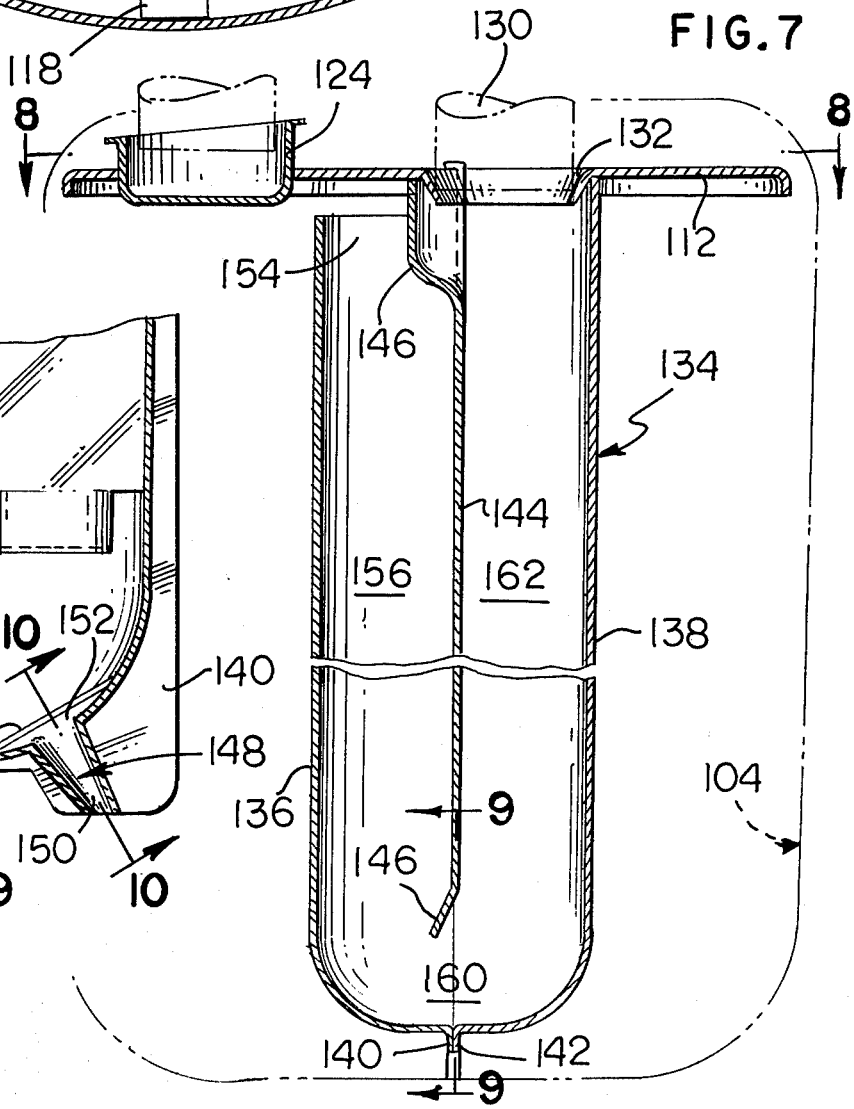
FIG. 7

SUCTION ACCUMULATOR

BACKGROUND OF THE INVENTION

The present invention relates to a refrigerant storage vessel for a refrigeration system located in line between the evaporator and the compressor. More particularly, the invention relates to a suction accumulator which separates the liquid components of the refrigerant from the gaseous components thereof and provides a storage or sump for the liquid refrigerant.

Most compressors adapted for use in refrigeration systems are designed for the compression of gaseous refrigerant. Under some circumstances, however, it is not unusual for a certain amount of liquid to flow from the evaporator into the inlet of the compressor. This condition, which is often referred to as slugging, may occur after the system in shut down and, if an accumulator is not provided, large quantities of condensed refrigerant return through the suction line to the crankcase of the compressor. When the compressor is restarted, the large quantity of liquid refrigerant present therein results in abnormally high pressures which frequently causes blown gaskets, broken valves, etc.

Suction accumulators, which are well known in the art, prevent this from occurring by providing a sump or storage for liquid refrigerant at the inlet to the compressor. A common type of accumulator comprises a vessel having a generally U-shaped tube received therein, one end of which is connected to an outlet pipe or tube extending into the vessel and the other end of which is open to the interior of the vessel. As the incoming liquid refrigerant flows into the vessel, it collects in the bottom thereof whereas the gaseous component is carried off through the U-tube to the outlet. A bleed-through orifice in the wall of the U-tube located in the lower portion of the vessel meters a small quantity of liquid refrigerant into the stream of gaseous refrigerant flowing through the tube so that a larger slug of refrigerant is not introduced into the inlet of the compressor on start-up or during operation thereof.

A sampling of prior art patents directed to this type of suction accumulator includes the following U.S. Pat. Nos. 4,009,596; 3,872,689; 3,563,053; 3,488,678.

SUMMARY OF THE INVENTION

The suction accumulator according to the present invention provides for improved gas-liquid separation of the incoming stream of refrigerant and is of a construction consisting predominantly of sheet metal stampings, which are economical to produce and easy to assemble. A first feature of the accumulator is the provision of a baffle between the inlet and outlet pipes having a portion thereof disposed beneath the inlet pipe the peripheral portion of which generally follows the contour of the vessel side wall and is spaced slightly therefrom. This, in combination with a suitably shaped and positioned deflector element adjacent the inlet, imparts tangential circular motion to the incoming refrigerant. This creates a vortex so as to cause the heavy components, of refrigerant, i.e. the liquid portion, to gravitate toward the outer wall and downwardly which enables the relatively drier gas to flow through the internally U-shaped conduit and out the outlet pipe to the compressor. The inlet end for the conduit is located at a position away from the vessel side wall so that there is little chance of the liquid refrigerant entering the conduit directly as it passes from the upper chamber to the lower chamber of the vessel, as defined by the baffle.

The structure of the U-shaped conduit, which is intended to include conduits where one leg is longer than the other so as to be J-shaped, is very compact and, since it is positioned axially within the vessel, does not interfere with the swirling motion of the liquid refrigerant. Unlike many prior art constructions, which are bent tubes, the conduit of the present invention is formed entirely from sheet metal stampings. This represents a significant reduction in manufacturing costs.

A third important feature of the accumulator is the configuration of the bleed-through orifice which is formed from a conical stamped recess is one-half of the conduit and a flat facing surface on the other half. At low temperatures, the lubricating oil mixed with the refrigerant is very viscous and it has been found that improved oil flow is achieved by drawing it into the conduit from a *narrower* orifice into a passageway having a gradually increasing diameter. In some prior art apparatus, the orifice was made larger in diameter so as to permit proper oil flow but necessitated the provision of screens and the like to prevent larger particles of dirt and the like from clogging it. The formation of the bleed-through orifice from metal stampings is advantageous from a manufacturing standpoint because it eliminates a separate drilling operation which would otherwise be necessary.

Specifically, the present invention contemplates a suction accumulator for the compressor of a refrigeration system including a storage vessel having an inlet, an outlet and side wall means, a conduit within the vessel extending downwardly into the lower portion thereof and being in fluid communication with the inlet and outlet. A bleed-through orifice in the conduit is positioned within the lower portion of the vessel and is preferably formed as a stamped recess in one of the sheet metal stampings forming opposite halves of the conduit. The improvement in the accumulator comprises a baffle interposed between the inlet and outlet and having a peripheral portion positioned below the inlet, the peripheral portion generally following the side wall means and being spaced slightly therefrom.

The invention further contemplates an improvement in the bleed-through orifice in the conduit, which orifice comprises one end opening into the conduit and the other end opening into the lower portion of the vessel, said one end being larger in cross-sectional area than the other end.

It is an object of the present invention to provide a suction accumulator which exhibits improved separation of the gas and liquid components of the incoming refrigerant and which minimizes the amount of liquid refrigerant which enters the compressor on start-up.

Another object of the present invention is to provide a suction accumulator wherein the close proximity of the peripheral portion of a baffle interposed between the inlet and outlet is spaced slightly from the edge of the vessel thus ensuring that only gaseous refrigerant will flow to the center of the pick-up tube while the liquid refrigerant collects within the lower portion of the vessel. Yet another object of the present invention is to provide a suction accumulator having a generally U-shaped conduit therein formed substantially entirely of sheet metal stampings thereby representing a substantial reduction in manufacturing costs.

A further object of the present invention is to provide a suction accumulator having a bleed-through orifice which is generally funnel-shaped, having an inlet end opening into the vessel which is smaller in diameter than its outlet end, which opens into the conduit.

A still further object of the present invention is to provide a suction accumulator wherein the bleed-through orifice is formed as a conical stamped recess in one of the halves constituting the U-tube.

These and other objects and features of the present invention will be apparent from the detailed description, together with the accompanying drawings.

BRIEF DESCRIPTION OF THE DRAWINGS

FIG. 7 is a fragmentary longitudinal sectional view taken along line 7—7 of FIG. 6;

FIG. 8 is a transverse sectional view taken along line 8—8 of FIG. 7;

FIG. 9 is an enlarged fragmentary sectional view taken along line 9—9 of FIG. 7; and FIG. 10 is a fragmentary sectional view taken along line 10—10 of FIG. 9.

DETAILED DESCRIPTION

Figure 1:
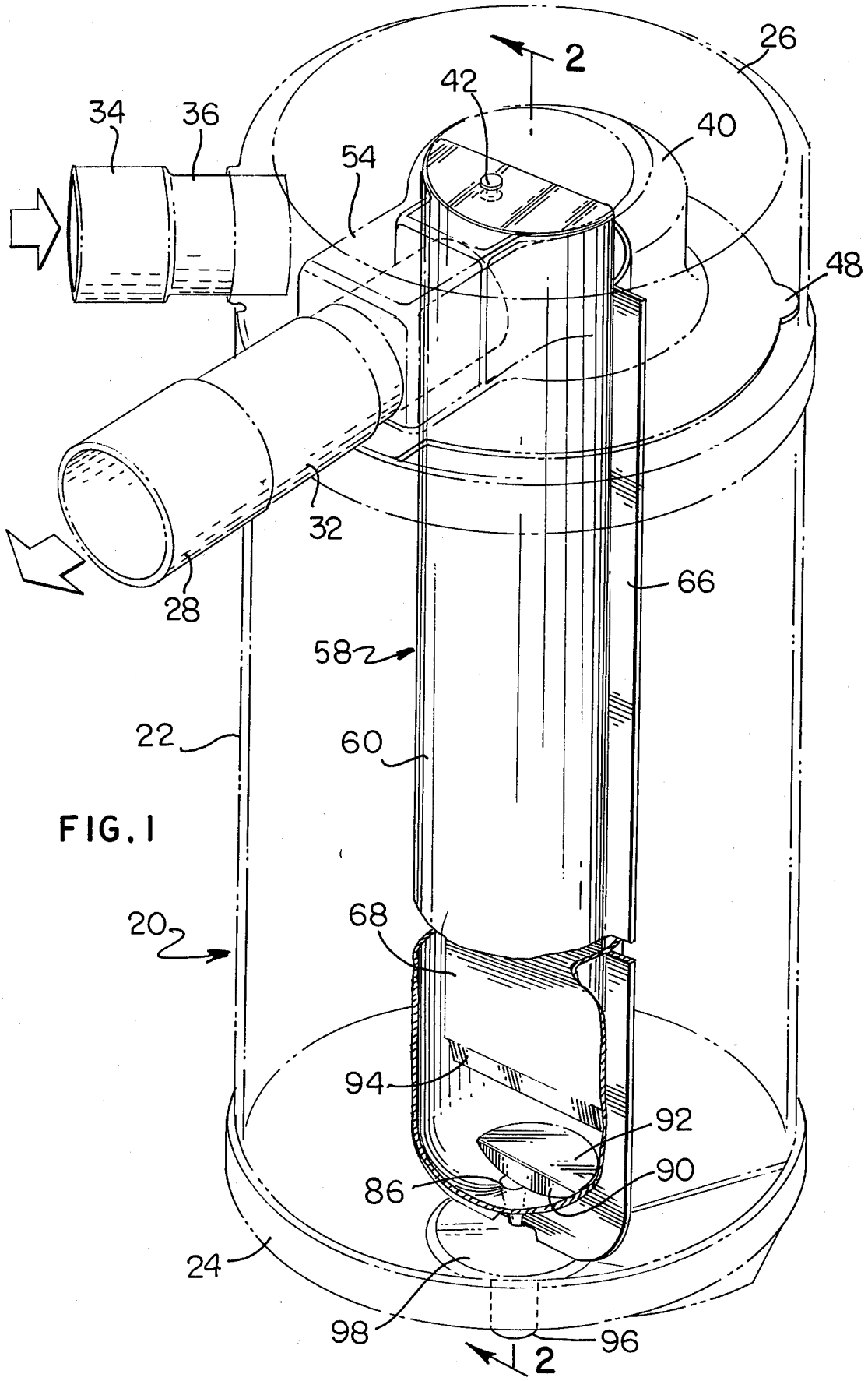
FIG. 1 is a perspective view of a first embodiment of the present invention having portions thereof cut away to illustrate the details of construction.

Referring now to FIGS. 1 through 5, a first embodiment of the present invention will be described. It comprises a storage vessel 20 comprising a generally cylindrical side portion 22 which is open at both ends and is provided with end caps 24 and 26 brazed or welded thereto. Side portion 22 need not be perfectly circular in cross-section, however, so long as the internal shape is such that circular swirling of the incoming refrigerant is enhanced. For example, a slightly ellipsoidal shape is also satisfactory. An outlet tube 28 extends through an opening 30 in upper cap 26 and has a slightly reduced diameter portion 32. Outlet tube 28 is adapted to be connected to the suction inlet of a compressor (not shown) in a refrigeration system. Inlet tube 34, also having a reduced diameter portion 36, extends through a second opening 38 in upper cap 26 and is adapted to be connected to the suction line of an evaporator (not shown). Inlet tube 34 and outlet tube 28 are rigidly secured to cap 26 as by brazing, for example.

A generally dome-shaped baffle element 40 is secured within the upper portion of vessel 20 by rivet 42. As illustrated in the drawings, baffle 40 includes a peripheral portion 44 which generally follows the contour of cap 26 and the inner surface 46 of side 22 and is spaced slightly therefrom by ears 48 and 50. One portion 52 of the exterior surface of baffle 40 is generally circular whereas the other portion 54 protrudes from portion 52 in the axial direction of outlet tube 28. An opening 56 in portion 54 provides clearance for the reduced diameter portion 32 of outlet tube 28 to extend within baffle 40.

Figure 2:
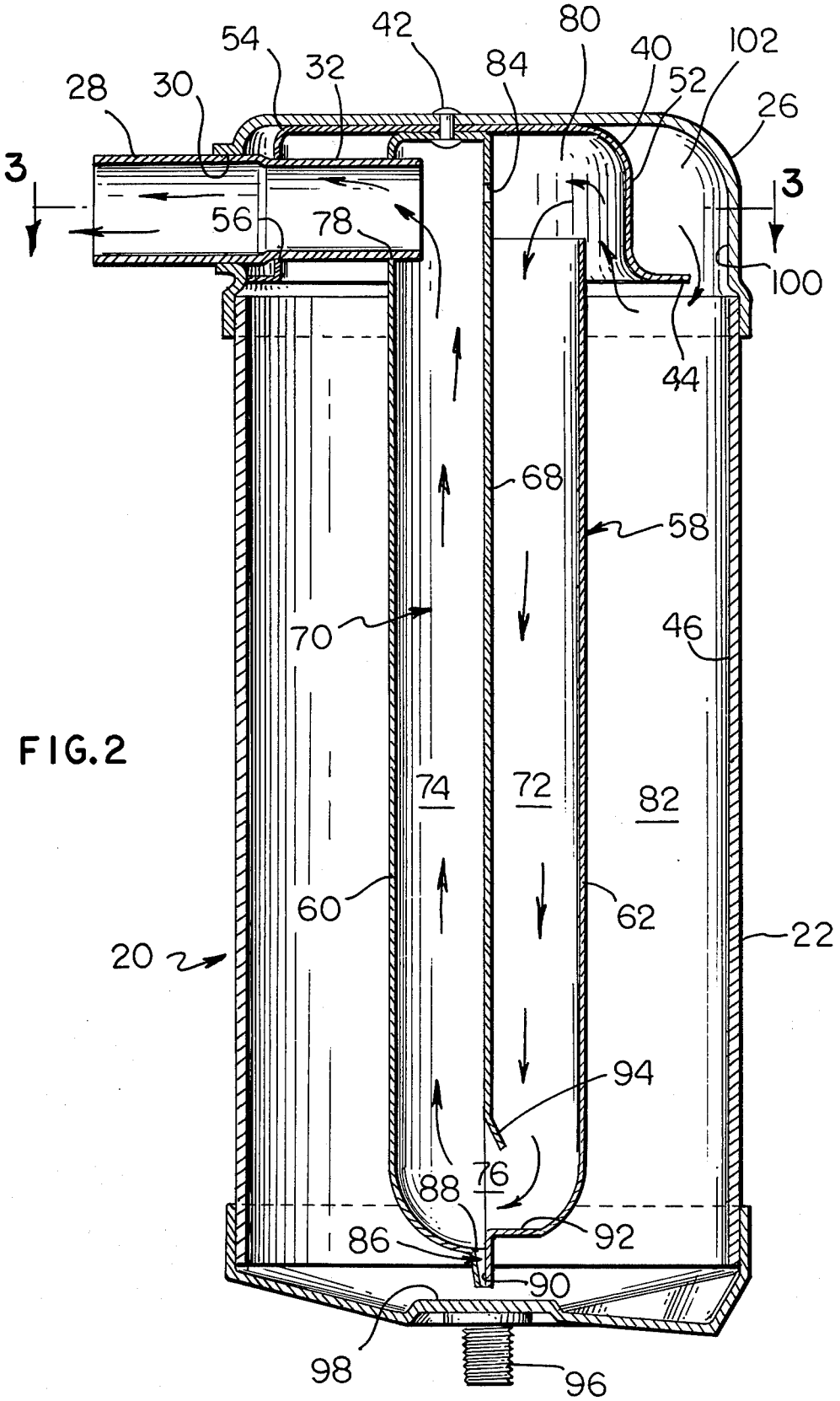
FIG. 2 is a longitudinal sectional view taken along line 2—2 of FIG. 1.
Figure 3:
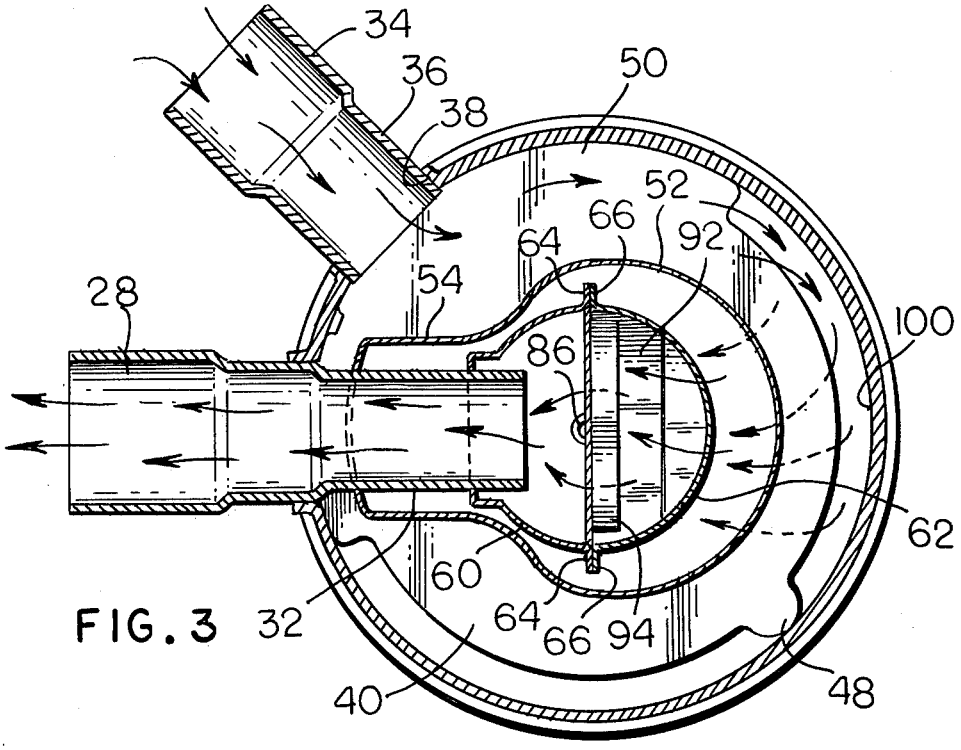
FIG. 3 is a transverse sectional view taken along line 3—3 of FIG. 2.
Figure 4:
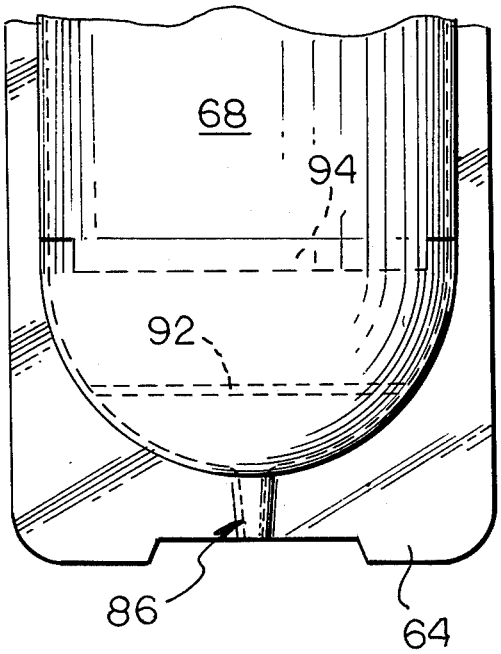
FIG. 4 is an enlarged fragmentary elevational view of the lower portion of the U-shaped inner conduit.
Figure 5:
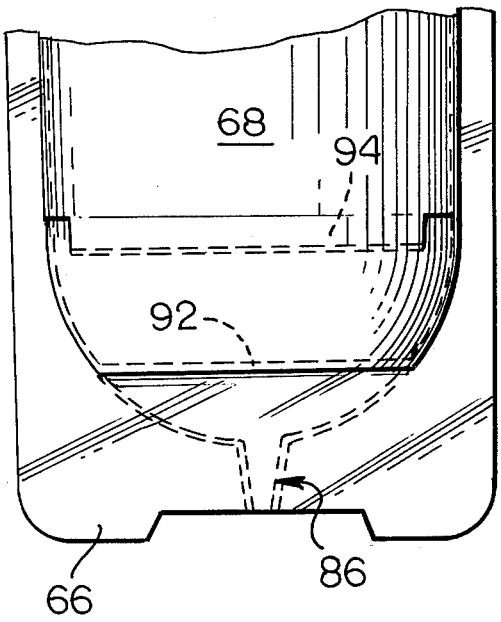
FIG. 5 is an enlarged fragmentary elevational view of the lower portion of the conduit viewed from the opposite side with respect to FIG. 4.
Figure 6:
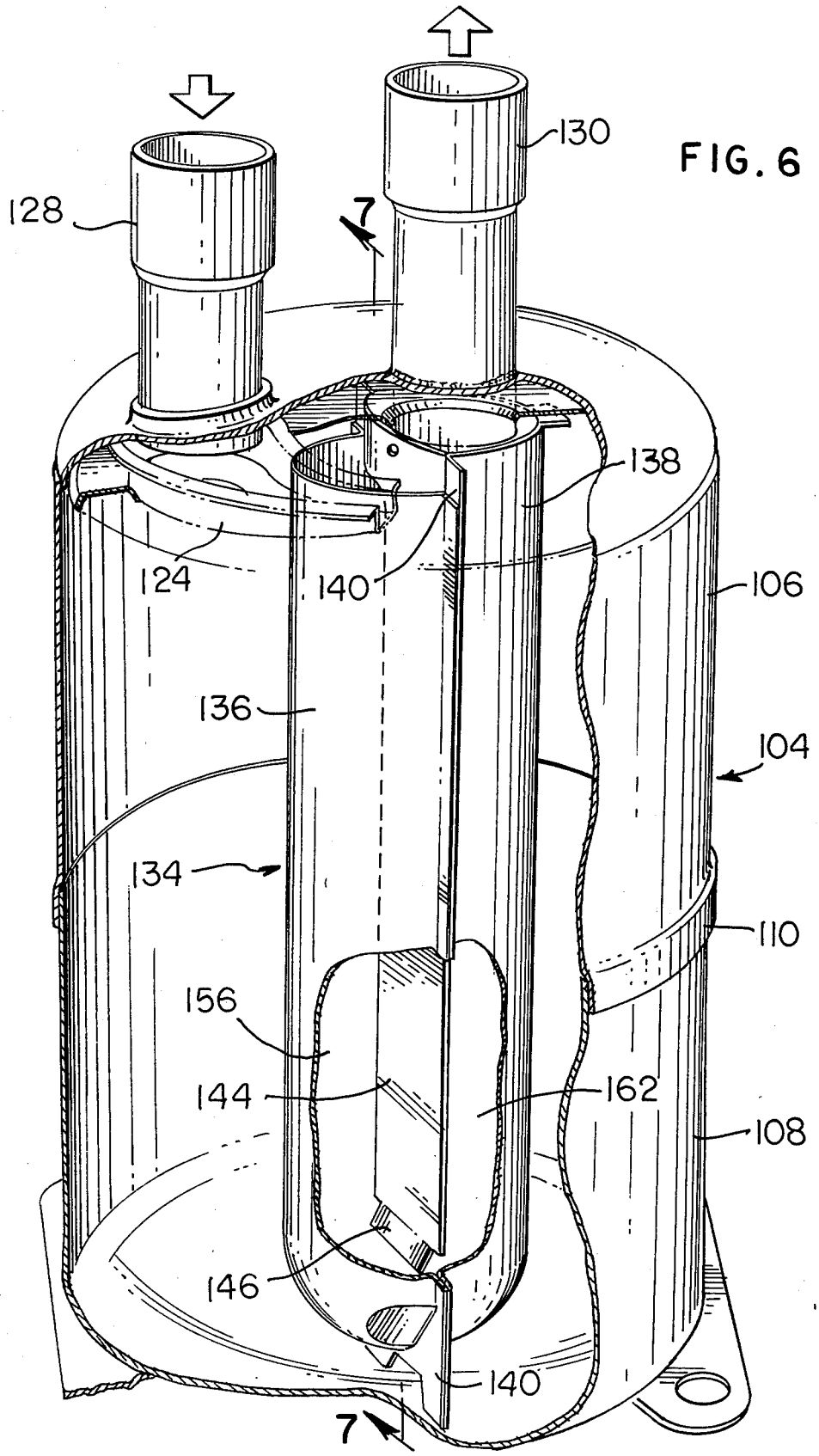
FIG. 6 is a perspective view of a second embodiment of the invention with portions thereof cut away to illustrate the details of construction.

Suspended within vessel 20 is a generally U-shaped conduit assembly 58 comprising a pair of sides 60 and 62 formed of sheet metal stampings brazed together along the respective flanges 64 and 66 so as to form a generally cylindrical housing. A stamped sheet metal weir plate 68 is brazed to sides 60 and 62 at their juncture and is spaced from the bottoms of sides 60 and 62 so as to form a generally U-shaped passageway 70 comprising inlet passageway 72, outlet passageway 74 and lower passageway 76. The left hand side 60 as viewed in FIG. 2 is connected to upper cap 26 by means of rivet 42. Outlet pipe 28 extends through an opening 78 in side 60 so as to be in direct fluid communication with outlet passageway 74. The upper end of inlet passageway 72 is open to the chamber 80 formed underneath baffle 40. It will be noted that this chamber 80 is open to the major chamber 82 formed within vessel 20. An opening 84 is provided in weir plate 68 within chamber 80.

A bleed-through orifice 86 within the lowermost portion of conduit 58 comprises a conical recess 88 formed within side 60 and the flat surface 90 of flange 66. This construction provides an orifice 86 which is generally funnel-shaped, having one side which is arcuate in shape in the transverse direction and the other side which is flat. This results in a cross-sectional area for the orifice 86 which increases continuously in the upper direction.

A land 92 is formed in side 62 so as to provide a surface slightly higher on one side of orifice 86 than the other. The lowermost portion of weir plate 68 forms an angle with the center line of conduit 58 to form a deflector 94 for refrigerant flowing down passageway 72. A mounting stud 96 may be secured to lower cap 24.

Although actual dimensions for the accumulator described above may vary depending on the particular design, a suitable size for orifice 86 is 0.0117–0.0145 square inches and its spacing from surface 98 in lower cap 24 is 0.090 inches. In order to minimize pressure drop in the accumulator, the cross-sectional areas of passageways 72, 74, and 76 as well as outlet tube 28 should be at least as large as the cross-sectional area of inlet tube 34. Similar dimensional constraints are desired with respect to the cross-sectional area of the space formed between the peripheral portion 44 of baffle 40 and the inner surface 100 of upper cap 26. Moreover, it is preferred that the cross-sectional area of this space be 250% of the cross-sectional area of inlet tube 34.

The embodiment described above, functions in the following manner. Incoming refrigerant from the evaporator, which is made up of both liquid and gaseous constituents, is drawn in through inlet tube 34. This strikes the external surface of baffle 40 and, due to the arcuate shape of portion 52 of baffle 40 and the arcuate inner surface 100 of upper cap 26, swirling motion is imparted to the liquid refrigerant. This causes it to flow in a circular manner tangentially to surface 100 and as it passes from upper chamber 102 to lower chamber 82 through the arcuate space between the peripheral portion 44 of baffle 40 and upper cap 26, its flow pattern is further confined to the periphery of chamber 82. Thus, the heavy liquid constituent of the incoming refrigerant is caused to swirl to the lower portion of vessel 20 whereas the gaseous constituent is drawn upwardly into chamber 80 and then downwardly in passageway 72. The swirling motion of the liquid refrigerant and oil mixtures serves to prevent separation of these two components.

As the gaseous refrigerant flows down passageway 72, it is deflected by deflector 94 so that the refrigerant does not impinge directly on orifice 86. As the gaseous refrigerant sweeps over land 92 and past orifice 86, a zone of lower pressure is formed above orifice 86 thereby causing liquid refrigerant and oil 104 within the lower portion of vessel 20 to be drawn upwardly through orifice 86. This zone of lower pressure is achieved by means of land 92. The liquid refrigerant laden gaseous refrigerant then flows upwardly through passageway 74 and out outlet tube 28 to the compressor.

By spacing the lowermost portion of orifice 86 as close to the bottom of lower chamber 82 as possible, the amount of oil which is trapped in the accumulator will be minimized. The advantage in forming orifice 86 as a recess in only one of the sides 60 is that there is no problem of misalignment during manufacturing as would be the case if recesses were formed in each of sides 60 and 62. The advantages of forming conduit assembly 58 of three sheet metal stampings 60, 62, and 68, aside from lower manufacturing costs, are less interference with the swirling action of the liquid refrigerant, and a more compact unit which permits greater liquid refrigerant storage capacity Referring now to FIGS. 6 through 10, a modified form of the suction accumulator according to the present invention will be described. It comprises a storage vessel 104 having an upper casing 106 and a lower casing 108 brazed or welded together along seam 110. A generally flat baffle plate 112 is secured to upper casing 106 by brackets 114, 116 and 118 and is spaced slightly from the inner surface 120 so as to form an annular space 122. A trough-like deflector element 124, secured to baffle plate 112, has its closed end 126 positioned directly beneath inlet tube 128 and is shaped such that tangential swirling motion is imparted to incoming liquid refrigerant. An outlet tube 130 extends through upper casing 106 and is brazed to the sides of opening 132 in baffle plate 112.

A conduit assembly 134, which is somewhat similar to conduit assembly 58, is suspended within vessel 104 from baffle plate 112. It comprises a pair of sides 136 and 138 which are brazed or welded together along their respective flanges 140 and 142. A weir plate 144 is brazed to sides 136 and 138 and to baffle plate 112. It will be noted that weir plate 144 includes an offset portion 146 to provide clearance for outlet pipe 130. The lower end of weir plate 144 is bent at an angle to the center line so as to form a deflector 146.

Bleed-through orifice 148 has a lower end 150 which is smaller in cross-sectional area than its upper end 152 and is formed as a conical recess in flange 140 that is closed on one side by the mating flat surface 153 on flange 142. Unlike the previous embodiment, however, orifice 148 is formed off to one side of the center line and has a longitudinal axis forming an angle therewith.

Incoming refrigerant flows into inlet tube 128 whereupon it strikes deflector element 124 and is caused to swirl adjacent inner surface 120. Because of the peripheral spacing of flange plate 112 and inner surface 120, the liquid refrigerant is prevented from entering the inlet end 154 of passageway 156 but, rather, is caused to flow to the lower portion of vessel 104. The gaseous constituent, on the other hand, is drawn through opening 154, down through passageway 156 and across orifice 148. Land 158 creates a low pressure zone at the upper end of orifice 148 thereby drawing liquid refrigerant and oil into lower passageway 160. The refrigerant and oil laden gaseous refrigerant is then drawn upwardly through passageway 162 and out outlet tube 130 to the compressor.

While this invention has been described as having a preferred design, it will be understood that it is capable of further modification. This application is, therefore, intended to cover any variations, uses, or adaptations of the invention following the general principles thereof and including such departures from the present disclosure as come within known or customary practice in the art to which this invention pertains, and as may be applied to the essential features hereinbefore set forth and fall within the limits of the appended claims.

What is claimed is:

1. A suction accumulator for a compressor of a refrigeration system comprising: a storage vessel having an upper portion, a lower portion, an inlet in the upper portion of the vessel, an outlet, and side wall means, a conduit within the vessel extending downwardly into the lower portion of the vessel and being in fluid communication with the inlet and outlet, a bleed-through orifice in the conduit located in the lower portion of the vessel, a baffle means interposed between the inlet and outlet and having a peripheral portion disposed below the inlet, said peripheral portion generally following the side wall means and being spaced slightly therefrom around at least a portion of the baffle periphery, and deflector means in the vessel upper portion having surface means positioned with respect to said inlet to cause generally unidirectional circular swirling movement of refrigerant entering said inlet, said deflector means and baffle means cooperating to cause swirling movement of incoming refrigerant in the upper portion of said vessel and of refrigerant passing between said baffle means and said side wall means.

2. The accumulator of claim 1 wherein said inlet comprises an inlet conduit which enters the vessel from the top at a point above said baffle means, and said deflector means includes an arcuate deflector trough positioned directly beneath said inlet conduit.

3. A suction accumulator for a compressor of a refrigeration system comprising: a storage vessel having an inlet, an outlet and side wall means, a conduit within the vessel being in fluid communication with the inlet and outlet and having a portion extending downwardly into the lower portion of the vessel, a bleed-through orifice in the conduit positioned within the lower portion of the vessel, baffle means positioned at least partially below said inlet and having a periphery generally following the side wall means at least a portion of said periphery being spaced from the vessel side wall means for causing incoming liquid refrigerant from said inlet to flow adjacent said side wall means past said baffle means, and deflector means in an upper portion of said vessel and having surface means positioned with respect to said inlet to cause generally unidirectional circular swirling movement of refrigerant entering said inlet, said deflector means and baffle means cooperating to cause swirling movement of incoming refrigerant in the upper portion of said vessel and of refrigerant passing between said baffle means and the vessel side wall means.

4. The accumulator of claim 3 wherein said inlet and outlet comprise respectively inlet and outlet pipes entering said vessel from the side in the upper portion thereof, and said deflector means and baffle means together comprise a generally dome-shaped deflector element secured to the upper portion of said vessel and having an outer surface in deflecting position in front of one end of said inlet pipe.

5. The accumulator of claim 3 wherein said inlet and outlet comprise respectively inlet and outlet pipes entering said vessel from the top and said baffle means comprises a plate having a periphery which generally follows the contour of said side wall means and is peripherally spaced slightly therefrom so as to define an annular opening.

6. The accumulator of claim 5 wherein the cross-sectional area of said annular opening is at least as large as the cross-sectional area of said inlet pipe.

7. The accumulator of claim 6 wherein the cross-sectional area of said annular opening is at least 250% of the cross-sectional area of said inlet pipe.

8. A suction accumulator for a compressor of a refrigeration system comprising:

a storage vessel having an upper portion and a lower portion, an inlet pipe and an outlet pipe connected to said vessel, a generally U-shaped conduit in said vessel having first and second generally vertically fluid passageways which are connected together by a third fluid passageway in the lowermost portion of said vessel, said outlet pipe being connected to said first passageway and being in fluid communication therewith, said second passageway opening into the upper portion of said vessel, a bleed-through orifice in said conduit providing an opening between said third assageway and the lowermost portion of said vessel, said conduit comprising a pair of elongated sheet metal stampings longitudinally secured together and a weir plate extending longitudinally therebetween so as to define said first, second and third passageways.

9. The accumulator of claim 8 including deflector means in said conduit in the lowermost portion of said vessel for deflecting refrigerant flowing through said second passageway away from said bleed-through orifice.

10. The accumulator of claim 8 wherein said orifice comprises a tapered recess in only one of said stampings extending between said third passageway and said vessel, said recess having one end opening into said third passageway, said one end being larger in cross-sectional area than the other end which opens into said vessel.

11. In a suction accumulator for a compressor of a refrigeration system including a storage vessel having an inlet and an outlet located in the upper portion thereof and a conduit extending from the outlet down into the lower portion of the vessel and back up to an opening in the conduit located within the upper portion of the vessel, the improvement comprising a tapered bleed-through opening in said conduit, said bleed-through opening having one end opening into said conduit and the other end opening into the lower portion of said vessel, said one end being larger in cross-sectional area than said other end.

12. The accumulator of claim 11 wherein said vessel includes a bottom, said conduit is vertically positioned within said vessel, said bleed-through opening extends in a generally downward direction, and said other end of said opening is in close proximity to the vessel bottom.

13. The accumulator of claim 11 wherein said conduit comprises a pair of vertical fluid passageways and a lower passageway in the lower portion of said vessel connecting said vertical passageways, said bleed-through opening extends generally downwardly from said lower passageway, and including deflector means extending partially across one of said vertical passageways for deflecting liquid refrigerant flowing down said one vertical passageway away from said bleed-through opening.

14. The accumulator of claim 11 wherein said conduit comprises a pair of vertical fluid passageways and a lower fluid passageway in the lower portion of said vessel connecting said vertical passageways, one of said vertical passageways being connected to said outlet and the other vertical passageway terminating at said conduit open end, and including an elevated surface in said lower passageway which is higher than said one end of said bleed-through opening, said elevated surface being adjacent said bleed-through opening.

15. The accumulator of claim 11 wherein said conduit comprises a pair of sheet metal stampings longitudinally secured together and a weir plate extending longitudinally therebetween.

16. The accumulator of claim 15 wherein said bleed-through opening comprises a conical recess in only one of said stampings extending from said one end of said opening to the other and which is closed on one side by a flat surface on the other of said stampings.

17. A suction accumulator for a compressor of a refrigeration system comprising: a storage vessel having a generally cylindrical side wall, an inlet and an outlet located in the upper portion of the vessel, a conduit within the vessel in fluid communication with the inlet and outlet and having a lower portion extending down into the lower portion of the vessel, a metering orifice in the lower portion of the conduit, a baffle means positioned at least partially beneath the inlet and wherein the periphery of the baffle generally follows the side of the vessel and is spaced slightly therefrom around at least a portion of said baffle periphery so as to provide a refrigerant passageway between the upper and lower portions of the vessel, and deflector means in the upper portion of said vessel directly opposite said inlet for causing incoming refrigerant to swirl about a vertical axis as it passes through said passageway.

18. In a suction accumulator for a compressor of a refrigeration system including a storage vessel having an inlet, an outlet, and side wall means, a conduit within the vessel extending downwardly into the lower portion of the vessel and being in fluid communication with the inlet and outlet, and a bleed-through orifice in the conduit located in the lower portion of the vessel, the improvement comprising a baffle interposed between the inlet and outlet and having a peripheral portion generally following the side wall means and being spaced slightly thereform around at least a portion of the baffle periphery, said conduit comprising means defining a generally U-shaped passageway having its first end connected to said outlet and its second end open to the interior of said vessel within the upper portion of said vessel, said orifice being located in the lowermost portion of said passageway.

19. The accumulator of claim 18 wherein said conduit extends longitudinally down said vessel and comprises a first half joined longitudinally to a second half, and a weir plate extending longitudinally between the first and second halves but terminating short of the lower ends of the first and second halves so as to define a lower passageway.

20. The accumulator of claim 19 wherein said conduit halves and said weir plate are sheet metal stampings.

21. The accumulator of claim 18 wherein said baffle is generally dome-shaped and said second end of said conduit is positioned within the dome-shaped, baffle.

22. The accumulator of claim 18 wherein:

said baffle is a dome-shaped deflector element mounted within the upper portion of said vessel and has an outer surface and an inner surface, said inlet comprises inlet conduit means extending into said vessel from the side for directing incoming liquid refrigerant against the outer surface of said deflector element, said second end of said conduit is positioned within said dome-shaped deflector element.

23. The accumulator of claim 22 wherein said outlet comprises a conduit which extends into said vessel from the side through said deflector element.

24. The accumulator of claim 18 wherein said bleed-through orifice is funnel-shaped and has a lower end opening into said vessel which is smaller in diameter than its upper end which opens into said U-shaped passageway.

* * * * *